United States Patent [19]

Russell

[11] Patent Number: 4,575,072

[45] Date of Patent: Mar. 11, 1986

[54] THERAPEUTIC RIDING DEVICE

[75] Inventor: Christine E. Russell, Denver, Colo.

[73] Assignee: Tiger Hug Toys, Inc., Denver, Colo.

[21] Appl. No.: 675,632

[22] Filed: Nov. 28, 1984

[51] Int. Cl.[4] ..... A63G 17/00

[52] U.S. Cl. ..... 272/52; 297/181; 297/458

[58] Field of Search ..... 272/52, 52.5, 53.1, 272/53.2; 104/61; 280/1.1 A, 1.16, 1.167, 1.182, 1.183, 1.184; 297/181, 195, 196, 202, 208, 209, 214, 458, 459, 460, DIG. 2; D21/248, 249, 74, 75

[56] References Cited

U.S. PATENT DOCUMENTS

| | | | |
|---|---|---|---|
| D. 77,531 | 1/1929 | Calleson | D21/75 X |
| D. 222,915 | 2/1972 | Alston | 272/52 UX |
| 2,452,869 | 11/1948 | Richards | 272/52 |
| 3,672,075 | 6/1972 | Eikelenboom | 272/53.2 X |
| 4,300,249 | 11/1981 | Taylor | 297/460 X |
| 4,367,897 | 1/1983 | Cousins | 297/458 X |

FOREIGN PATENT DOCUMENTS

| | | | |
|---|---|---|---|
| 1491140 | 2/1969 | Fed. Rep. of Germany | 297/458 |
| 742697 | 12/1955 | United Kingdom | 272/53.1 |

*Primary Examiner*—Robert A. Hafer
*Assistant Examiner*—Arnold W. Kramer
*Attorney, Agent, or Firm*—Fields, Lewis, Pittenger & Rost

[57] ABSTRACT

A therapeutic riding device includes a seat (21) with a base (22), an upright portion (23) having a back (24) and wraparound sides (25, 26), and a hump (28). A coil spring (35) supports the seat. A pair of footrests (41, 42) position and support the feet and a hand grip (51) positions the hands and arms whereby to support a rider with abnormal muscle tone so as to reduce spasticity through a reflex-inhibiting posture.

10 Claims, 6 Drawing Figures

THERAPEUTIC RIDING DEVICE

TECHNICAL FIELD

This invention in general relates to riding devices and more particularly to a novel and improved therapeutic riding device for use by a cerebral palsied child to reduce spasticity.

BACKGROUND ART

Cerebral palsied children have abnormal muscle tone which prevents their use of conventional recreational and body building devices.

It has been found that spasticity in a child can be reduced through reflex-inhibiting posture which can be provided by positioning the body in a particular manner which enables the child to exert body muscles without the influence of abnormal spastic patterns. Abnormal spastic patterns prohibit the normal use and development of muscle tone.

There are no known riding devices that are suitable for this purpose.

DISCLOSURE OF INVENTION

A riding device disclosed has a seat, a center hump forwardly of the seat, handle grips and footrests all constructed and positioned in relation to one another to properly position and support a cerebral palsied rider so as to reduce spasticity through a reflex-inhibiting posture, thereby allowing the rider more normal muscle tone in the use and development of his muscles.

BRIEF DESCRIPTION OF DRAWINGS

The details of this invention will be described in connection with the accompanying drawings, in which.

DETAILED DESCRIPTION

Figure 1:
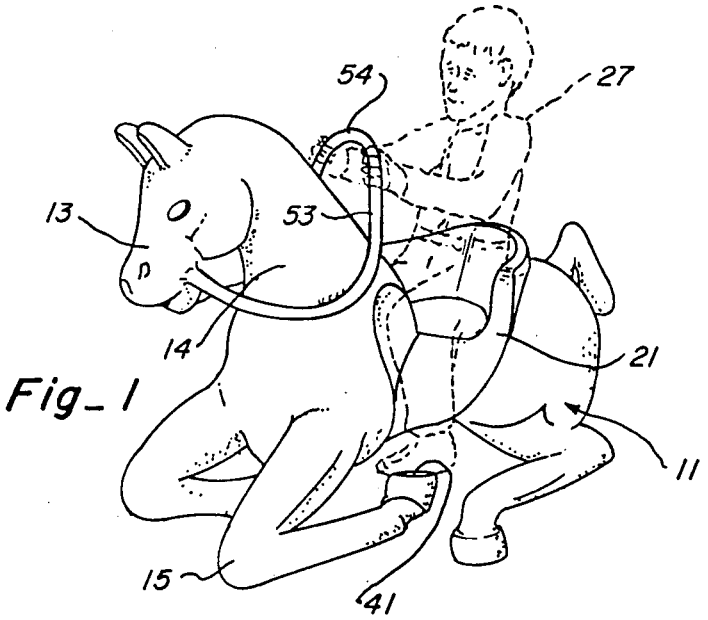
FIG. 1 is a front elevation view of a riding device embodying features of the present invention with a child shown in dashed lines in a riding position thereon.
Figure 2:
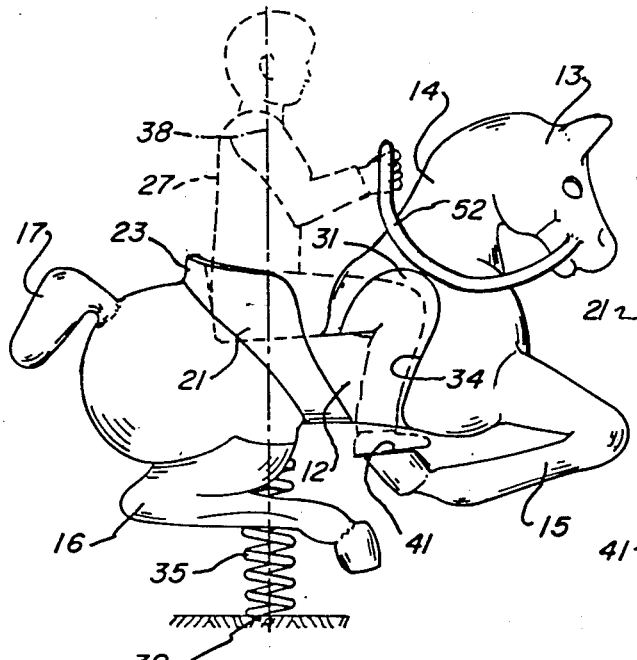
FIG. 2 is a right side elevation view of the device of FIG. 1.
Figure 3:
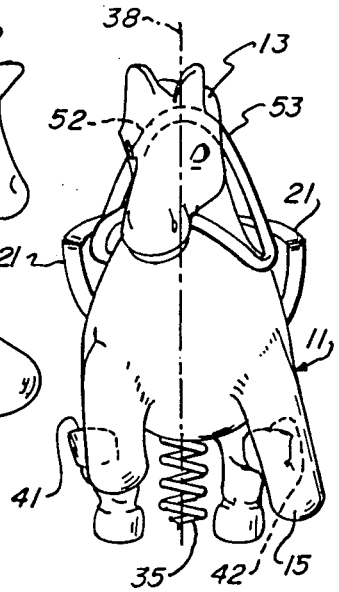
FIG. 3 is a front elevation view of the device.
Figure 4:
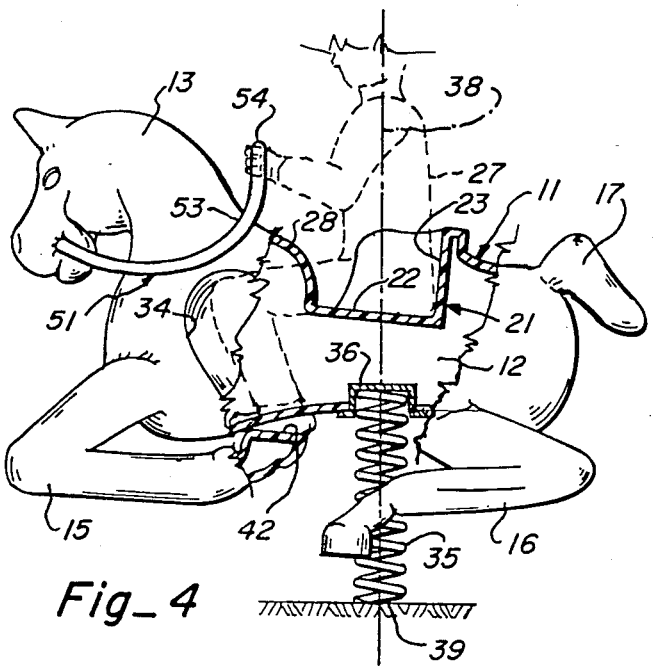
FIG. 4 is a left side elevation view of the device with portions broken away to show cross-sectional shapes of several of the parts.
Figure 5:
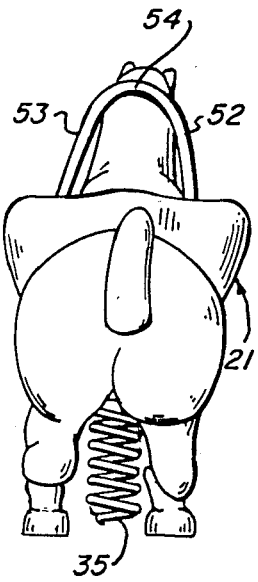
FIG. 5 is a rear elevation view of the device.
Figure 6:
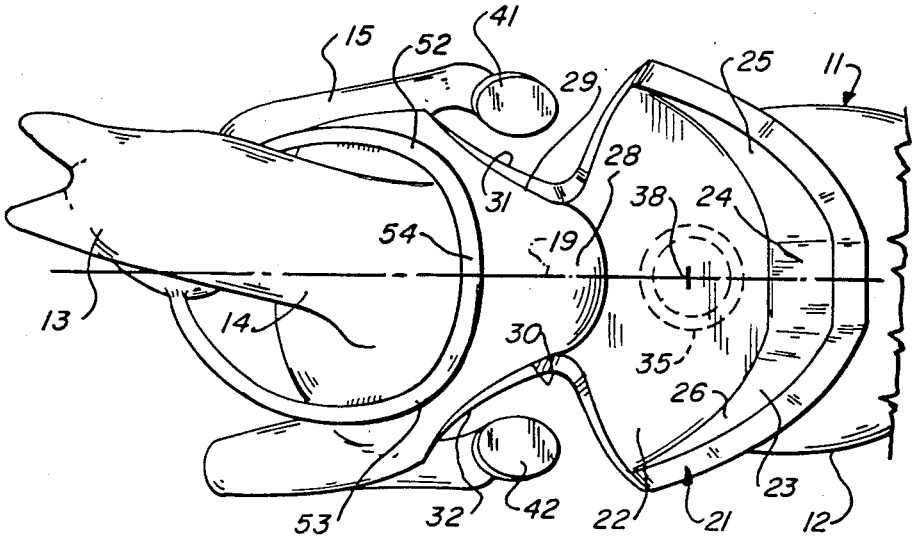
FIG. 6 is a top plan view of the forward portion of the device.

Referring now to the drawings, the device shown comprises a unitary hollow member or body 11 in the form of a riding horse having a generally barrel-shaped trunk 12, a head 13, a neck 14, front legs 15, rear legs 16, and a tail 17. A preferred material for body 11 is fiberglass. The neck is shown turned to one side so as to be at an angle to the longitudinal center line 19 of the trunk 12. While a horse body shape has been shown, it is understood that the device of the present invention may take a variety of forms and the horse shape is selected as one form of animal that can be used to add attractiveness for use by children.

The device shown has a seat 21 recessed into the top of the trunk 12. Seat 21 includes a flat base 22 and an upright portion 23. Portion 23 has a centrally disposed flat back 24 and wraparound sides 25 and 26 extending forwardly of the opposite sides of the back 24 and symmetrically arranged in relation to the longitudinal center line 19. A rider 27, illustrated as a child of about age 3, is shown in dashed lines in a riding position on the seat 21. Children between the ages of 1 and 4 will be able to use the device.

The base 22 of the seat has a rearward and downward tilt, preferably about 5°, to facilitate trunk flexion and to inhibit spastic extension by the rider. The back 24 of the seat provides lower lumbar stimulation to the rider and by so doing can encourage an upright sitting position using normal extension.

The wraparound sides 25 and 26 serve as a pelvis support that stabilizes the pelvis of the rider and frees the rider from the need to stabilize by fixing in spastic positions. This pelvic stability provides a base from which the rider can achieve substantially optimal trunk position and extremity function. This allows the rider to build more normal trunk tone as the rider works the body trunk.

An upwardly projecting convexly curved hump 28 is disposed forwardly of the seat 21. This hump 28 has curved side sections 29 and 30 symmetrically arranged on opposite sides of the longitudinal center line 19. The hump provides leg abduction and prevents both abnormal adduction and internal rotation at the hip, thereby providing good lower extremity position through reflex-inhibitory posture. The hump 28 also provides for optional weight-bearing on the palms of the hands of the rider allowing tactile and proprioceptive feedback to the brain.

A pair of side leg recesses 31 and 32 are formed in the trunk 12 below and forwardly of the seat into which the legs of the rider extend. The forward side of each leg recess has a forwardly and upwardly inclined front surface 34 to accommodate wide ranges of leg lengths.

A resilient base in the form of a coil spring 35 is shown secured in a bottom cap 36 recessed in the bottom of the trunk 12. The cap 36 and spring 35 are located on a vertical axis 38 that is at the center of gravity of the seat with a rider seated thereon. The lower end of the spring 35 is anchored at the bottom such as, for example, embedded in a concrete base indicated at 39. The spring supports the seat for a full 360-degree range of flexure to enable a range of movement that encourages body trunk strengthening on posterior, anterior, lateral and diagonal planes.

For use with children, the coil spring 35 would preferably be covered to prevent the child from getting caught or pinched thereon.

A pair of footrests 41 and 42 are provided on opposite sides of the longitudinal center line 19 and trunk 12 below associated leg recesses 31 and 32, respectively, and below the trunk 12. More specifically, in the embodiment shown the footrests are provided by extending the front legs of the horse so that the hooves form the footrests. The footrests 41 and 42 have rearwardly and downwardly inclined foot supporting surfaces, preferably at a 5-degree angle to the horizontal so as to be substantially parallel to the seat base 22. The footrests provide for slight foot dorsiflexion, thereby preventing spastic leg extension thrust and encouraging proper leg flexion.

A hand grip member 51 is mounted on the horse head 13 forwardly of the seat and hump and includes a pair of side rod portions 52 and 53 symmetrically arranged on opposite sides of the longitudinal center line 19 with an intermediate rod portion 52 joining the upright rod portions. The upright rod portions 52 and 53, which are shown as gripped by the hands of the rider, extend along a vertical axis. The thumbs of the rider are shown pointed up.

The hand grip member 51 with the curved upright portions as shown facilitates muscle tone normalization in a variety of ways. The hand grip member provides an option of symmetrical hand grasping in a supinated position, or asymetrical hand grasping allowing one hand to be supinated while the second hand maintains a neutral position. The hand grip member encourages a moderately extended arm position. To accommodate various child heights it provides an option of several shoulder levels, allowing the child to maintain depressed shoulders and thereby reducing spasticity and allowing optimal trunk function. The hand grip member encourages a good hand grasp with thumb abduction and thumb and forefinger opposition.

Although the present invention has been described with a certain degree of particularity, it is understood that the present disclosure has been made by way of example and that changes in details of structure may be made without departing from the spirit thereof.

What is claimed is:

1. A therapeutic riding device for reducing spasticity in a rider such as a cerebral palsied child, said device comprising:

a seat with a base and an upright portion, said base being substantially flat and having a slight rearward and downward tilt to facilitate trunk flexion and inhibit spastic extension of the rider, said upright portion including a substantially flat back and wraparound sides extending forwardly of the opposite sides of said back with said back having a slight rearward tilt to form a body cup for the pelvis of the rider from which the rider can achieve a substantially optimal trunk position and extremity function so as to build a more normal muscle tone as the rider exercises the trunk:

a hump forwardly of said seat and symmetrically arranged on opposite sides of the center line of said seat, said hump extending up and forwardly along an arc from the forward edge of said base and further extending laterally out and forwardly along opposite arcs, said hump providing leg abduction and preventing both abnormal adduction and internal rotation at the hip, thereby providing good lower extremity position through reflex-inhibiting posture;

resilient base means supporting said seat for tilting about a vertical axis through substantially a full 360-degree range of flexure by a rider on said seat to encourage trunk strengthening on posterior, anterior, lateral and diagonal planes;

a pair of footrests symmetrically arranged on opposite sides of the longitudinal center line of said seat and having rearwardly and downwardly inclined foot support surfaces and being substantially parallel to said seat base, said footrests providing a slight foot dorsiflexion to prevent spastic leg extension thrust and encourage proper leg flexion; and a hand grip member forwardly of said seat including a pair of upright rod portions symmetrically arranged on opposite sides of said longitudinal center line and an intermediate rod portion connecting said upright rod portions, said hand grip member facilitating muscle tone normalization by providing an option of symmetrical hand grasping in a supinated position or asymmetrical hand grasping allowing one hand to be supinated while the second hand maintains a neutral position with a moderately extended arm position and a range of shoulder levels allowing the rider to maintain depressed shoulders to reduce spasticity and provide optimal trunk function and further to enable good hand grasp with thumb abduction and thumb and forefinger opposition.

2. A therapeutic riding device as set forth in claim 1 wherein said base, back, and footrests tilt at an angle of about 5°.

3. A therapeutic riding device as set forth in claim 1 wherein said resilient base means includes a coil spring secured to the seat and anchored at the lower end.

4. A therapeutic riding device as set forth in claim 1 wherein the lower portions of said upright rod portions extend forwardly along an arc.

5. A therapeutic riding device as set forth in claim 1 wherein said seat and hump are recessed in a barrel-shaped body having a pair of side leg recesses formed in said body below and forwardly of said seat.

6. A therapeutic riding device as set forth in claim 5 wherein said body has a forwardly and upwardly inclined surface defining the forward extremity of said leg recesses.

7. A therapeutic riding device as set forth in claim 5 wherein said body is in the shape of a horse.

8. A therapeutic riding device as set forth in claim 7 wherein said footrests are formed by the hooves of said horse.

9. A therapeutic riding device as set forth in claim 5 wherein said body and seat have the same longitudinal center line.

10. A therapeutic riding device for reducing spasticity in a rider such as a cerebral palsied child, said device comprising:

a unitary barrel-shaped body;

a seat with a base and a wraparound upright portion recessed in the top of said body, said base being substantially flat and having a slight rearward and downward tilt to facilitate trunk flexion and inhibit spastic extension of the rider, said upright portion including a substantially flat back and wraparound sides extending forwardly of the opposite sides of said back having a flat surface providing lower lumbar stimulation to the rider to form a body cup for the pelvis of the rider, said sides stabilizing the pelvis and freeing the rider from the need to stabilize by fixing in spastic positions and further providing a base from which the rider can achieve a substantially optimal trunk position and extremity function so as to build a more normal muscle tone as the rider exercises the trunk;

leg recesses in opposite sides of said body;

a hump forwardly of said seat and symmetrically arranged on opposite sides of the center line of said seat, said hump extending up and forwardly along an arc from the forward edge of said base and further extending laterally out and forwardly along opposite arcs, said hump providing leg abduction and preventing both abnormal adduction and internal rotation at the hip, thereby providing good lower extremity position through reflex-inhibiting posture, said hump further providing for weight-bearing on the palms of the hands;

resilient base means supporting said seat for tilting about a vertical axis through substantially a fully 360-degree range of flexure by a rider on said seat to encourage trunk strength on posterior, anterior, lateral and diagonal planes;

a pair of footrests symmetrically arranged on opposite sides of the longitudinal center line of said seat and having rearwardly and downwardly inclined foot support surfaces and being substantially parallel to said seat base, said footrests providing a slight foot dorsiflexion to prevent spastic leg extension thrust and encourage proper leg flexion; and a hand grip member forwardly of said seat including a pair of upright rod portions symmetrically arranged on opposite sides of said longitudinal center line and an intermediate rod portion connecting said upright rod portions, said rod portions and said hand grip member facilitating muscle tone normalization by providing an option of symmetrical hand grasping in a supinated position or asymmetrical hand grasping allowing one hand to be supinated while the second hand maintains a neutral position with a moderately extended arm position and a range of shoulder levels allowing the rider to maintain depressed shoulders to reduce spasticity and provide optimal trunk function and further to enable good hand grasp with thumb abduction and thumb and forefinger opposition.

* * * * *